US010619338B2

(12) United States Patent
Loggia et al.

(10) Patent No.: US 10,619,338 B2
(45) Date of Patent: Apr. 14, 2020

(54) GASKET AND KIT FOR USE WITH A TOILET

(71) Applicant: MÉDIA K-PLUS INC./K-PLUS MEDIA INC., Mont-Royal (CA)

(72) Inventors: Rosario Loggia, Saint-Léonard (CA); Claudio Cardinale, Montréal (CA); Alfi Cardinale, Montréal-Nord (CA); Georghe Adrian Petcu, Montréal (CA); Joseph Isidoro Di Franco, Montréal (CA)

(73) Assignee: MÉDIA K-PLUS INC./K-PLUS MEDIA INC., Mont-Royal (CA)

( * ) Notice: Subject to any disclaimer, the term of this patent is extended or adjusted under 35 U.S.C. 154(b) by 149 days.

(21) Appl. No.: 15/525,951

(22) PCT Filed: Nov. 12, 2015

(86) PCT No.: PCT/CA2015/051166
§ 371 (c)(1),
(2) Date: May 10, 2017

(87) PCT Pub. No.: WO2016/074082
PCT Pub. Date: May 19, 2016

(65) Prior Publication Data

US 2019/0003170 A1 Jan. 3, 2019

Related U.S. Application Data

(60) Provisional application No. 62/077,967, filed on Nov. 11, 2014, provisional application No. 62/116,720, filed on Feb. 16, 2015.

(51) Int. Cl.
*E03D 11/16* (2006.01)
*E03D 11/13* (2006.01)

(52) U.S. Cl.
CPC ..... *E03D 11/16* (2013.01); *E03D 11/13* (2013.01)

(58) Field of Classification Search
CPC ..... E03D 11/16; E03D 11/13
(Continued)

(56) References Cited

U.S. PATENT DOCUMENTS 3,568,222 A 3/1971 Gantzert
4,032,996 A 7/1977 Sargent et al.
(Continued)

FOREIGN PATENT DOCUMENTS

WO 02063198 8/2002

OTHER PUBLICATIONS

English Abstract of CN2484364(Y), "Water closet mounting seal ring", published on Apr. 3, 2002.
(Continued)

*Primary Examiner* — Tuan N Nguyen
(74) *Attorney, Agent, or Firm* — Bereskin & Parr LLP/S.EN.C.R.L., s.r.l.

(57) ABSTRACT

A toilet gasket includes a planar portion and a tubular portion. The planar portion defines an opening for alignment with an outlet duct of a toilet and an inlet of a waste pipe. A bottom surface of the planar portion is adapted to sealingly engage a surface surrounding the waste pipe. The tubular portion extends from the bottom surface of the planar portion and about the opening. The tubular portion defines a channel in fluid communication with the opening. An outer surface of the tubular portion has at least one rib member for sealingly engaging the inner surface of the waste pipe when the tubular portion is inserted within the waste pipe. A kit includes the toilet gasket, a toilet flange and bolts for securing the toilet, the toilet flange and a floor structure.

19 Claims, 13 Drawing Sheets

(58) Field of Classification Search
USPC ..... 4/252.6, 252.5
See application file for complete search history.

(56) References Cited

U.S. PATENT DOCUMENTS

| | | | | |
|---|---|---|---|---|
| 4,271,539 | A | 6/1981 | Roberts | |
| 4,285,075 | A | 8/1981 | Nelson | |
| 4,423,526 | A | 1/1984 | Izzi, Sr. | |
| 4,886,302 | A | 12/1989 | Forbes | |
| 4,940,113 | A | 7/1990 | L'Heureux | |
| 5,185,890 | A | 2/1993 | Dismore et al. | |
| 5,309,579 | A | 5/1994 | Nelson | |
| 5,608,922 | A | 3/1997 | Lewis | |
| 6,065,160 | A | 5/2000 | Winn | |
| 6,128,947 | A | 10/2000 | Anderson, Sr. | |
| 6,789,275 | B2 | 9/2004 | Spells, Sr. et al. | |
| 7,069,603 | B2 | 7/2006 | Flushing | |
| 7,458,109 | B1 | 12/2008 | Kreisel | |
| 7,584,970 | B2 | 9/2009 | Ponce | |
| 8,671,470 | B2 | 3/2014 | Miller et al. | |
| 8,955,172 | B2 * | 2/2015 | Culwell | E03D 11/16 4/252.6 |
| 2001/0023505 | A1 | 9/2001 | Atkins | |
| 2001/0045710 | A1 * | 11/2001 | Nguyen | E03D 11/16 277/604 |
| 2002/0067006 | A1 | 6/2002 | Etcheverry | |
| 2009/0158512 | A1 | 6/2009 | Stickler et al. | |
| 2011/0056006 | A1 | 3/2011 | Colligan | |
| 2011/0131715 | A1 | 6/2011 | Culwell | |
| 2013/0219603 | A1 | 8/2013 | Wendorff | |
| 2013/0227772 | A1 | 9/2013 | Schuster | |
| 2013/0298323 | A1 * | 11/2013 | Mares | E03D 11/16 4/252.1 |

OTHER PUBLICATIONS

English Abstract of CN2642871(Y), "Sealing gasket for closet", published on Sep. 22, 2004.
English Abstract of CN201024520(Y), "Flush toilet bottom rubber sealing gasket", published on Feb. 20, 2008.

* cited by examiner

GASKET AND KIT FOR USE WITH A TOILET

CROSS REFERENCE TO RELATED APPLICATIONS

The present application is a 35 USC 371 national stage entry of PCT/CA2015/051166 filed on Nov. 12, 2015 and which claims priority to U.S. 62/077,967 filed on Nov. 11, 2014 and to U.S. 62/116,720 filed on Feb. 16, 2015. These documents are hereby incorporated by reference in their entirety.

FIELD OF THE DISCLOSURE

The present disclosure relates to a gasket and a kit for use with a toilet, and more particularly, a gasket providing multiple manner of sealing the toilet.

BACKGROUND OF THE DISCLOSURE

Installation of a toilet typically requires forming a seal between an outlet of the toilet and a waste pipe (also called drain pipe, sewage pipe or soil pipe) in the floor of the bathroom. Inadequate sealing of the outlet of the toilet with the waste pipe can lead to various types of leaks that can further cause undesirable mess and potential damage to the bathroom.

Typically, a toilet wax ring disposed around an inlet of the waste pipe is used to form the seal between the toilet and the waste pipe. While the toilet wax ring is effective for providing a direct seal between the outlet of the toilet and the waste pipe, it does not provide sealing against other potential leaks. Moreover, installation of the wax ring presents of a high level of difficulty for some users.

SUMMARY

It would thus be highly desirable to be provided with a device, system or method that would at least partially address the disadvantages of the existing technologies.

The embodiments described herein provide in one aspect, a toilet gasket comprising:

a planar portion defining a primary opening for alignment with an outlet duct of a toilet and an inlet of a waste pipe, a bottom surface of the planar portion being adapted to sealingly engage a surface surrounding the waste pipe;

a tubular portion extending from the bottom surface of the planar portion and about the opening, the tubular portion defining a channel in fluid communication with the opening, an outer surface of the tubular portion having at least one rib member being adapted to sealingly engaging the inner surface of the waste pipe when the tubular portion is inserted within the waste pipe.

The embodiments described herein provide in another aspect, a kit comprising the gasket as described herein, a flange defining a plurality of openings and being adapted to be secured to an underlying surface and at least two fasteners adapted to project through secondary openings of the planar portion and the openings of the flange to secure the toilet and the flange.

The embodiments described herein provide in yet another aspect, a method for reducing damages caused by toilet water spillage or toilet water backflow, the method comprising channeling the water backflow flowing from a waste pipe towards the outlet duct of the toilet and into a bowl of the toilet by means of one piece toilet gasket comprising ribs contacting the inside wall of the waste pipe; and using the toilet gasket for at least substantially preventing water found on a floor surrounding the toilet to flow through a floor aperture defined around the waste pipe.

The embodiments described herein provide in yet another aspect, a method for reducing damages caused by toilet water spillage or toilet water backflow, the method comprising channeling the water backflow flowing from a waste pipe towards the outlet duct of the toilet and optionally into a bowl of the toilet by means of one piece toilet gasket comprising ribs contacting the inside wall of the waste pipe; and using the toilet gasket for at least substantially preventing water found on a floor surrounding the toilet to flow through a floor aperture defined around the waste pipe.

According to another aspect, there is provided a toilet gasket comprising:

a planar portion defining a primary opening for alignment with an outlet duct of a toilet and an inlet of a waste pipe, a bottom surface of the planar portion being dimensioned to sealingly engage a floor surface surrounding the waste pipe, the planar portion defining a surface area that is equal or inferior to a surface area defined by a base of the toilet;

a tubular portion extending from the bottom surface of the planar portion and about the opening, the tubular portion defining a channel in fluid flow communication with the opening, wherein the toilet gasket is optionally made of a single piece.

DRAWINGS

The following drawings represent non-limitative examples in which.

DESCRIPTION OF VARIOUS EMBODIMENTS

Figure 1:
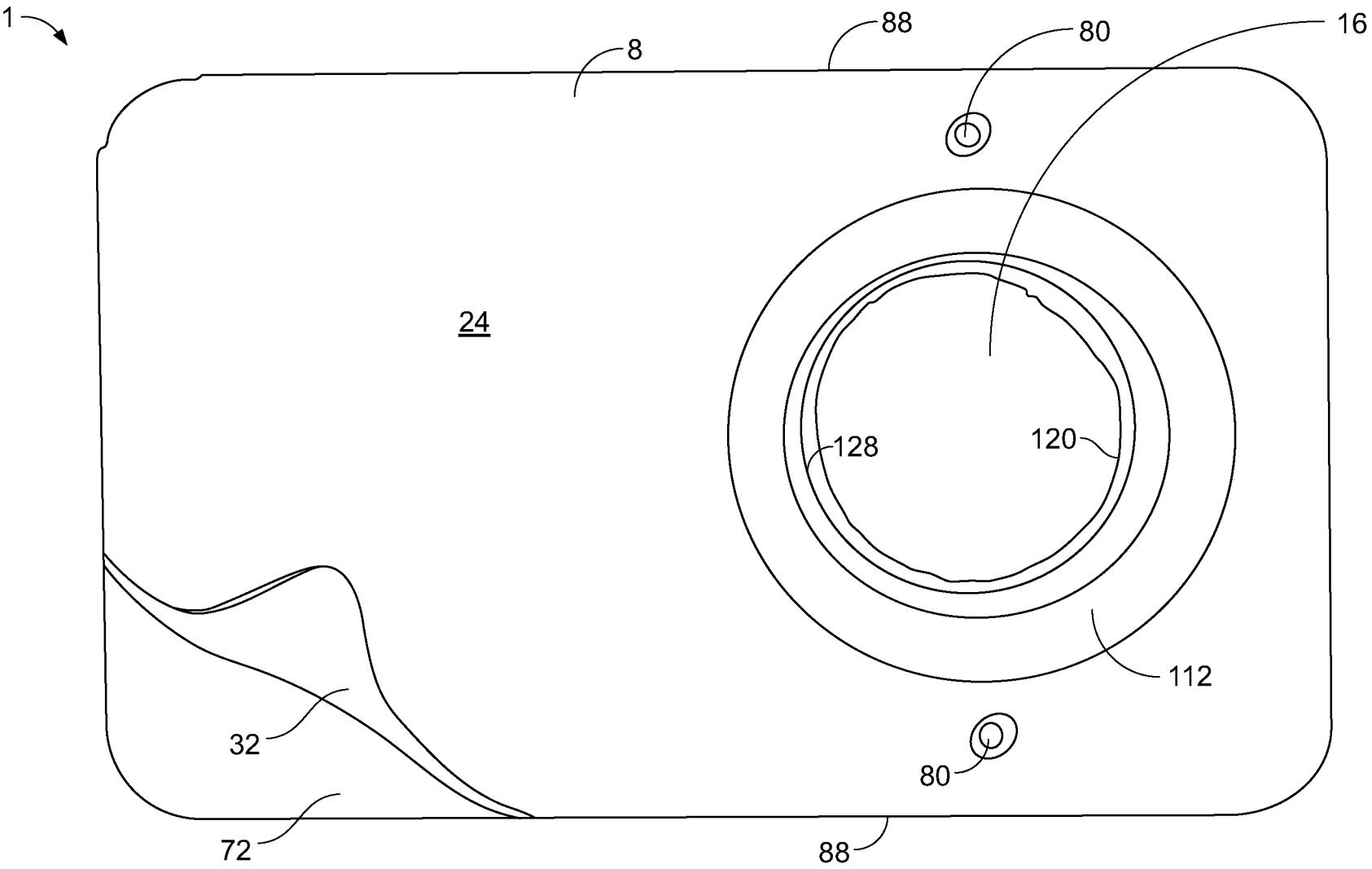
FIG. 1 illustrates a plan view of a toilet gasket according to one exemplary embodiment.

The following examples are presented in a non-limiting manner.

For example, according to toilet gaskets disclosed herein, the gasket further comprises an annular member extending from the top surface of the planar portion and about the opening and being adapted to sealingly engage at least one of an end wall and outer side wall of the outlet of the toilet.

For example, according to toilet gaskets disclosed herein, sealing engagement of the outlet of the toilet with the annular member restricts flow of water between the outlet and the top surface of the planar portion.

For example, according to toilet gaskets disclosed herein, the planar portion is sized to extend substantially beyond an outer wall of the outlet of the toilet and within the exterior walls of a base of the toilet.

For example, according to toilet gaskets disclosed herein, the bottom surface of the planar portion is coated with adhesive, the adhesive further being covered by a removable layer.

For example, according to toilet gaskets disclosed herein, removal of the removable layer exposes the adhesive, the adhesive being adapted to adhere the bottom surface of the planar portion to the surface surrounding the waste pipe to form a seal therewith.

For example, according to toilet gaskets disclosed herein, sealing engagement of the rib with the inner surface of the waste pipe restricts flow of water between the outer surface of the tubular member and the inner surface of the waste pipe during backflow of water in the waste pipe, thereby channeling the backflow towards the outlet duct of the toilet and into a bowl of the toilet.

For example, according to toilet gaskets disclosed herein, sealing engagement of the planar portion with the floor surface restricts flow of water standing on the surface surrounding the waste pipe between the planar portion and the top surface towards an area in proximity of the waste pipe.

For example, according to toilet gaskets disclosed herein, sealing engagement of the planar portion with the floor surface substantially prevents water disposed outside the base of the toilet from flowing through a floor opening defined within the floor and around the waste pipe.

For example, according to toilet gaskets disclosed herein, sealing engagement of the planar portion with the floor surface substantially prevents water from flowing through a floor opening defined within the floor and around the waste pipe.

For example, according to toilet gaskets disclosed herein, varying a distance of the insertion of the tubular portion into the waste pipe maintains the sealing engagement of the at least one rib member with the inner surface of the waste pipe.

For example, according to toilet gaskets disclosed herein, the planar portion and the tubular portion are formed by molding.

For example, according to toilet gaskets disclosed herein, the planar portion and the tubular portion are formed of at least one of rubber, soft plastic and polymer.

For example, according to toilet gaskets disclosed herein, the planar portion further defines a plurality of secondary openings for receiving fasteners.

For example, according to toilet gaskets disclosed herein, the gasket comprises a fire retardant.

For example, according to toilet gaskets disclosed herein, the planar portion is substantially flexible and is adapted to conform to discontinuities in the surface surrounding the waste pipe.

For example, according to kits disclosed herein, the at least two fasteners are at least two closet bolts.

For example, according to kits disclosed herein, the kit further comprises instructions for installing the kit and connecting it to the toilet.

The word "a" or "an" when used in conjunction with the term "comprising" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

Referring now to FIG. 1, therein illustrated is a plan view of a toilet gasket 1 for use with a toilet. The toilet gasket 1 includes a planar portion 8 that defines a primary opening 16. The planar portion 8 further includes a top surface 24 and a bottom surface 32.

The primary opening 16 may be sized according to a size of the opening 40 of an outlet duct 48 of a toilet 52 and the size of the opening 56 of a waste pipe 64. For example, the primary opening 16 may be sized to have a diameter that is slightly less than a diameter of the opening 40 of the outlet duct 48 of the toilet and the size of the opening 56 of the waste pipe 64. When being installed, the primary opening 16 of the planar portion 8 is to be aligned with the opening 40 of the outlet duct 48 of the toilet 52 and the opening 56 of the waste pipe 64.

Waste pipe 64 herein refers to any pipe that leads water and waste material out of the building where the toilet 52 is installed. For example, the waste pipe 64 may lead to a main sewage system or a septic tank providing storage of waste material.

The bottom surface 32 of the planar portion 8 is adapted to sealingly engage a surface. The bottom surface 32 and the surface form a watertight seal. For example, the bottom surface 32 may be adhered to the surface using an appropriate adhesive material so as to form the seal therewith. The surface may be a substantially flat surface such as the top surface of the floor of the bathroom where the toilet is to be installed. For example, the surface may be the top surface of a finished flooring of the bathroom. Finished flooring herein refers to the layer of finish material applied over a floor structure. The floor structure may be plywood, cement, brick or other basic material for providing the structure of a building. The finished flooring may be tiles (ex: ceramic tiles), stone, wood (ex: hardwood, engineered wood, laminate flooring), linoleum, etc.

According to some exemplary embodiments, the planar portion 8 may be substantially flexible so as to conform to discontinuities within the surface to which it is to be adhered. For example, tiled finished flooring may include gaps between tiles filled with a filler material. Similarly, a stone floor may have a slightly rough surface. The flexible nature of the planar portion 8 allows the bottom surface 32 of the planar portion 8 to conform to such discontinuities so as to form a watertight seal with the surface. For example, the planar portion 8 may be formed of a soft plastic, rubber, or flexible polymer material.

According to various exemplary embodiments, the planar portion 8 of the toilet gasket 1 is sized so as to extend beyond the area of the exposed the underlying floor structure and to contact the areas where the finished flooring is still applied. Accordingly, the planar portion 8 forms a seal with at least a portion of the finished flooring that it is contacting.

According to various exemplary embodiments, the bottom surface 32 of the planar portion 8 is pre-coated with adhesive or any kind of sealing material. The bottom surface 32 may be further covered by a removable layer 72 that protects the adhesive coating. When the planar portion 8 of the gasket 1 is to be applied to form a seal, the removable layer 72 is removed to expose the adhesive coating. The planar portion 8 can then be applied by abutting the bottom surface 32 to the surface surrounding the waste pipe 64, thereby adhering the planar portion 8 to the surface and forming a watertight seal. For example, the removable layer 72 can be peeled away to expose the adhesive coating. Advantageously, pre-coating the bottom surface 32 allows for application of the planar portion 8 of the gasket 1 without use of additional tools or having to provide additional adhesives.

According to various exemplary embodiments, the planar portion 8 further defines a plurality of secondary openings 80 for receiving fasteners used in installation of the toilet 52. The fasteners can project through the second openings 80 to secure parts disposed above the gasket 1 with parts disposed below the gasket 1.

For example, and as illustrated, the planar portion 8 may have an elongated shape to correspond to a generally elongated shape of a base of a toilet. The secondary openings 80 may be further positioned between the primary opening 16 and the elongated edges 88 of the planar portion 8. It will be appreciated that the position of the secondary openings 80 correspond to openings in the base 92 of the toilet used for securing the toilet.

According to one exemplary embodiment, the planar portion 8 has a width of approximately 8 inches, a length of approximately 12 inches and a thickness of approximately 1/32 inches.

According to another exemplary embodiment, the planar portion 8 has a width of approximately 9 inches, a length of approximately 12 inches and a thickness of approximately 1/32 inches.

It will be appreciated that the planar portion 8 is substantially planar in that it can be generally characterized as extending along one plane. According to some exemplary embodiments, both a top surface 24 and a bottom surface 32 of the planar portion are substantially flat (i.e. no protrusions other than the tubular portion 96 and/or the annular member 112). According to some other exemplary embodiments, at least the bottom surface 32 of the planar portion is substantially flat so as to sealingly engage a surface, while the top surface 16 may have one or more protrusions. According to yet other exemplary embodiments, the bottom surface 32 may include a continuous wall extending from the bottom surface 32, whereby the continuous wall is adapted to sealingly engage a surface.

Figure 2:
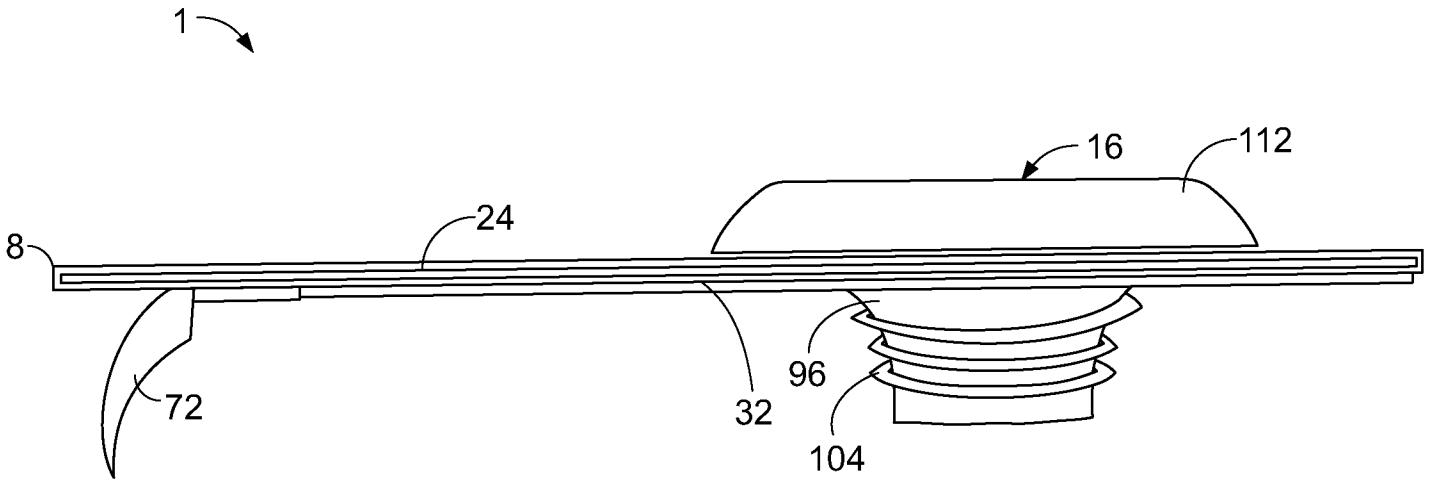
FIG. 2 illustrates a side elevation view of the exemplary toilet gasket of FIG. 1.

Referring now to FIG. 2, therein illustrated is a side elevation view of the toilet gasket 1 according to one exemplary embodiment. The toilet gasket 1 further includes a tubular portion 96 extending from the bottom surface 32 of the planar portion 8. The tubular portion 96 further extends circumferentially about the opening 16, thereby defining a channel in fluid communication with the opening 16. The tubular portion 96 is adapted to be inserted into a waste pipe 64.

The tubular portion 96 further includes at least one annular rib 104 extending circumferentially about the outer surface of the tubular portion 96. As illustrated, and for example purposes, three annular ribs 104 extend circumferentially about the outer surface of the tubular portion 96. For example, the at least one annular rib 104 may have a circumference of about 3 inches to about 5 inches, about 3¼ inches to about 3½ inches or about 4¼ inches to about 4½ inches.

The annular rib 104 may be substantially flexible. For example, the annular rib 104 may be formed of soft plastic, rubber, or a suitable polymer. For example, the annular rib 104 may be formed of the same material as the planar portion 8.

The annular rib 104 may have an outer diameter that is slightly greater than an inner diameter of the waste pipe 64 into which the tubular portion 96 is to be inserted. Accordingly, when the tubular portion 96 is inserted into the waste pipe 64, the outer portion of the annular rib 104 abuts against and engages an inner surface of the waste pipe 64 so as to form a watertight seal therewith.

As illustrated, and according to various exemplary embodiments, the tubular portion 96 may be tapered. The tapered shape of the tubular portion 96 may further promote engagement of the at least one annular rib 104 with the inner surface of the waste pipe 64.

According to various exemplary embodiments, the toilet gasket 1 further includes an annular member 112 extending from the top surface 24 of the planar portion 8. The annular member 112 further extends circumferentially about the opening 16. The annular member 112 may be spaced from an edge 120 of the opening 16 to define an annular lip 128. The annular member 112 is sized to receive the outlet duct 48 of the toilet 52. For example, the walls defining the outlet duct 48 of the toilet 52 contacts the annular member 112 to form a watertight seal therewith. For example, the annular member 112 sealingly engages at least one of an end wall 160 and outer sidewall 168 of the outlet of the toilet. The annular member 112 provides a watertight seal between the outlet duct 48 of the toilet 52 and the waste pipe 64. It will be appreciated that the annular member 112 provides the sealing function provided by a typical wax ring. According to various exemplary embodiments, the annular member 112 extends from the top surface 24 of the planar portion for a distance of about ⅝ of an inch.

According to various exemplary embodiments, the planar portion 8 and the tubular portion 96 are integrally formed. The annular member 112 may be further integrally formed with the planar portion 8 and the tubular portion 96. Accordingly, toilet gasket 1, including the planar portion 8, the tubular portion 96 and the annular member 112, may form a unitary piece. According to some exemplary embodiments, the planar portion 8 and the tubular portion 96 may be formed using a molding process. The annular member 112 may also be formed within the molding process.

According to various exemplary embodiments, the toilet gasket 1 may be formed of a material that includes a fire retardant.

Figure 3:
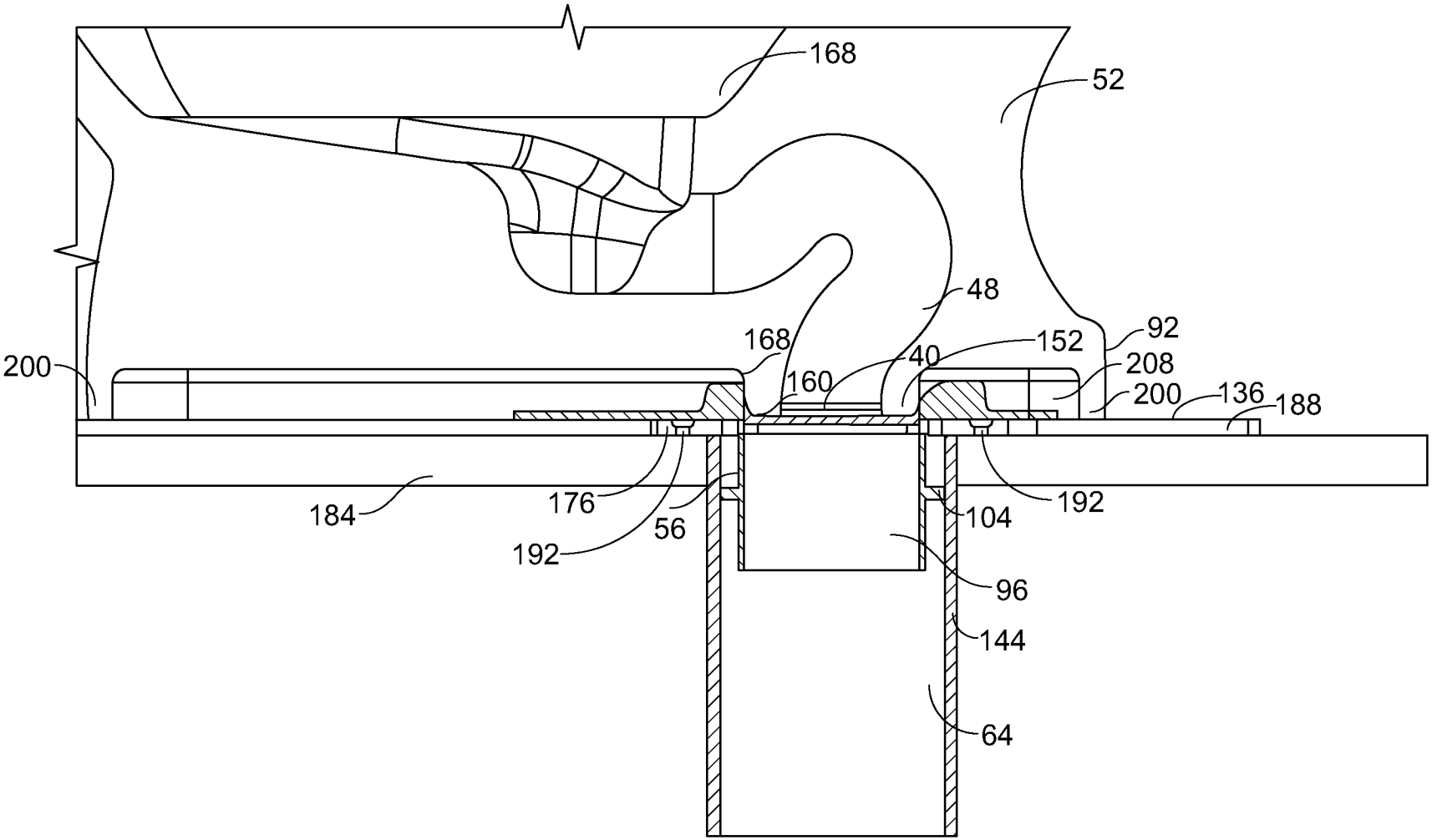
FIG. 3 illustrates a side section view of an exemplary toilet installation using the exemplary toilet gasket of FIG. 1.

Referring now to FIG. 3, therein illustrated is a side section view of the exemplary toilet gasket 1 having been applied in an exemplary toilet installation. As illustrated, the gasket 1 is positioned so that the tubular portion 96 is inserted into a top portion of a waste pipe 64 and the planar portion 8 is disposed over the surface 136 of the finished flooring 188 surrounding the waste pipe 64. The at least one annular rib 96 of the tubular member abuts and sealingly engage the inner wall 144 of the waste pipe 64. The planar portion 8 further sealingly engages the surface 136 of the finished flooring 188.

Continuing with FIG. 3, the side walls 152 defining an outlet duct 48 of the toilet 52 is received within the annular member 112. As illustrated, the end wall 160 abuts the lip 128 of the annular member 112 and the outer sidewall 164 abuts the inner surface of the annular member 112, thereby forming a watertight seal. The outlet duct 48 is in fluid communication with the waste pipe 64 via the opening 40 of the outlet duct 48, the opening 16 defined by the planar portion 8 of the toilet gasket 1 and the opening 56 of the waste pipe 64. As liquid and waste material is flushed from the toilet bowl 168 of the toilet 52, the liquid and waste material travels from the outlet duct 48 to the waste pipe 64 to enter a main sewage system or a septic tank.

A toilet flange 176 may be further provided between the bottom surface 32 of the planar portion 8 and the floor structure 184. The flange 176 may be a known toilet flange 176 typically used in toilet installations. For example, the toilet flange 176 includes a plurality of channels for receiving first fasteners (not shown in FIG. 3) that secure the base 92 of the toilet 52 to the flange 176. For example, the first fasteners may be flange bolts or closet bolts. The toilet flange 176 further includes a plurality of openings 192 for receiving floor screws (not shown in FIG. 3) for securing the flange 176 to the floor structure 184. Accordingly, the toilet 52 is secured to the floor structure 184 through the toilet flange 176.

According to various exemplary embodiments, and as illustrated, the planar portion 8 is sized to extend over the surface 136 of the finished flooring 188 beyond the side walls 152 of the outlet duct 48 of the toilet 52. However, the planar portion 8 is sized so as to not extend past the outer walls 200 of the of the toilet base 92. It will be appreciated that the outer walls 200 of the toilet base 92 defines an inner chamber 208 and the toilet gasket 1 is located entirely within the inner chamber 208. Accordingly, when the toilet 52 is fully installed with the toilet gasket 1, one cannot visually distinguish the installation using the toilet gasket 1 from a typical installation, such as using a wax ring, because the toilet gasket 1 is hidden from view within the inner chamber 208.

Figure 4:
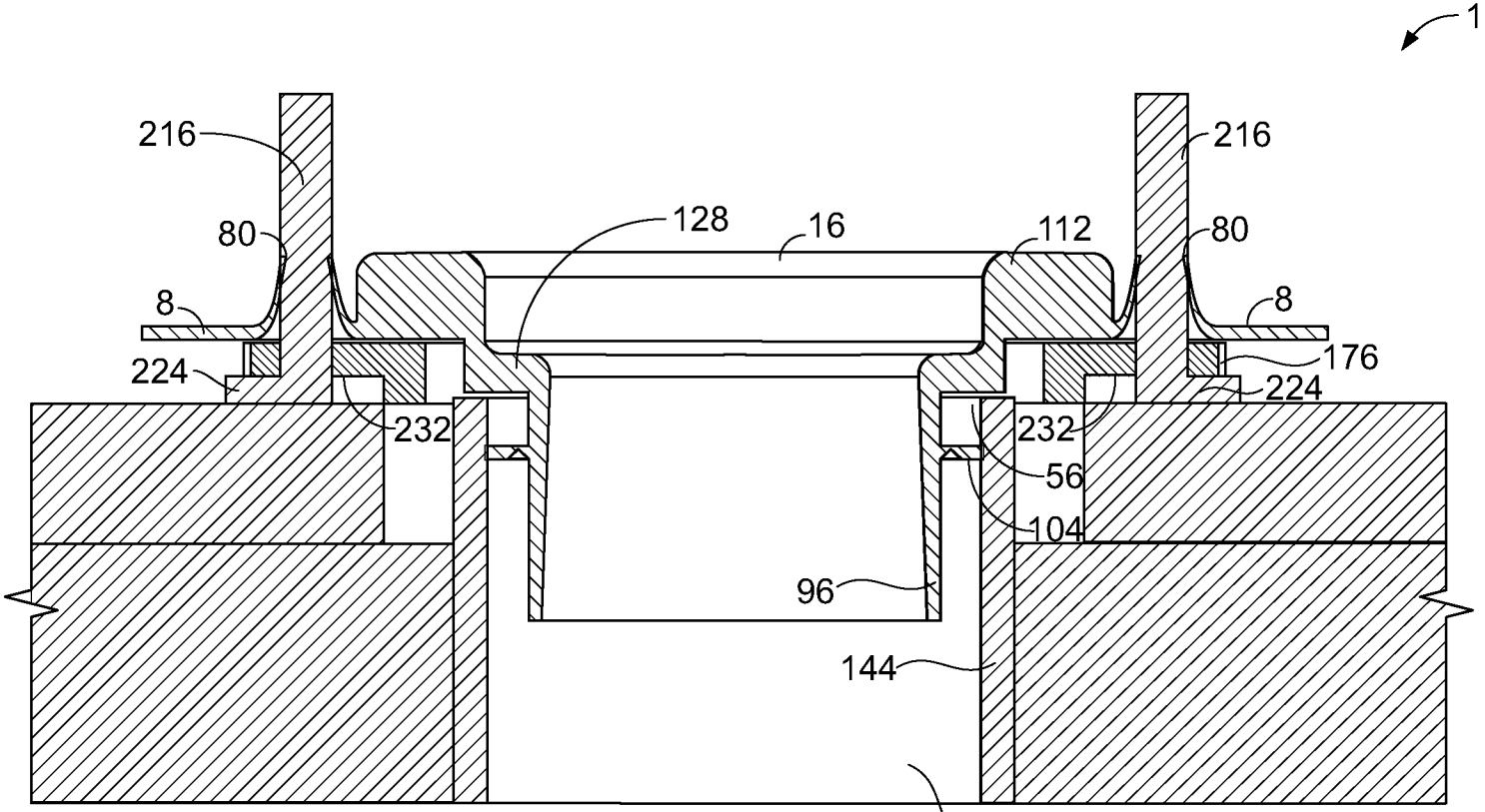
FIG. 4 illustrates a front section view of an exemplary partial toilet installation using the exemplary toilet gasket of FIG. 1.

Referring now to FIG. 4, therein illustrated is a front section view of an exemplary toilet gasket 1 at an intermediate stage of installation of a toilet 52. As illustrated, fasteners 216 are positioned so that the head 224 of the each bolt 216 engage a bottom surface 232 of the toilet flange 176. Accordingly, the fasteners 216 are restricted from an upward movement in relation to the flange 176. The fasteners 216 further project through secondary openings 80 of the planar portion 8. The exposed portion of the bolts 216 can therefore be received within fasteners opening in the base 92 of a toilet 52. Suitable nuts can then be used to secure the base 92 of the toilet 52 to the flange 176.

For example the fasteners 216 can be closet bolts.

Figure 5:
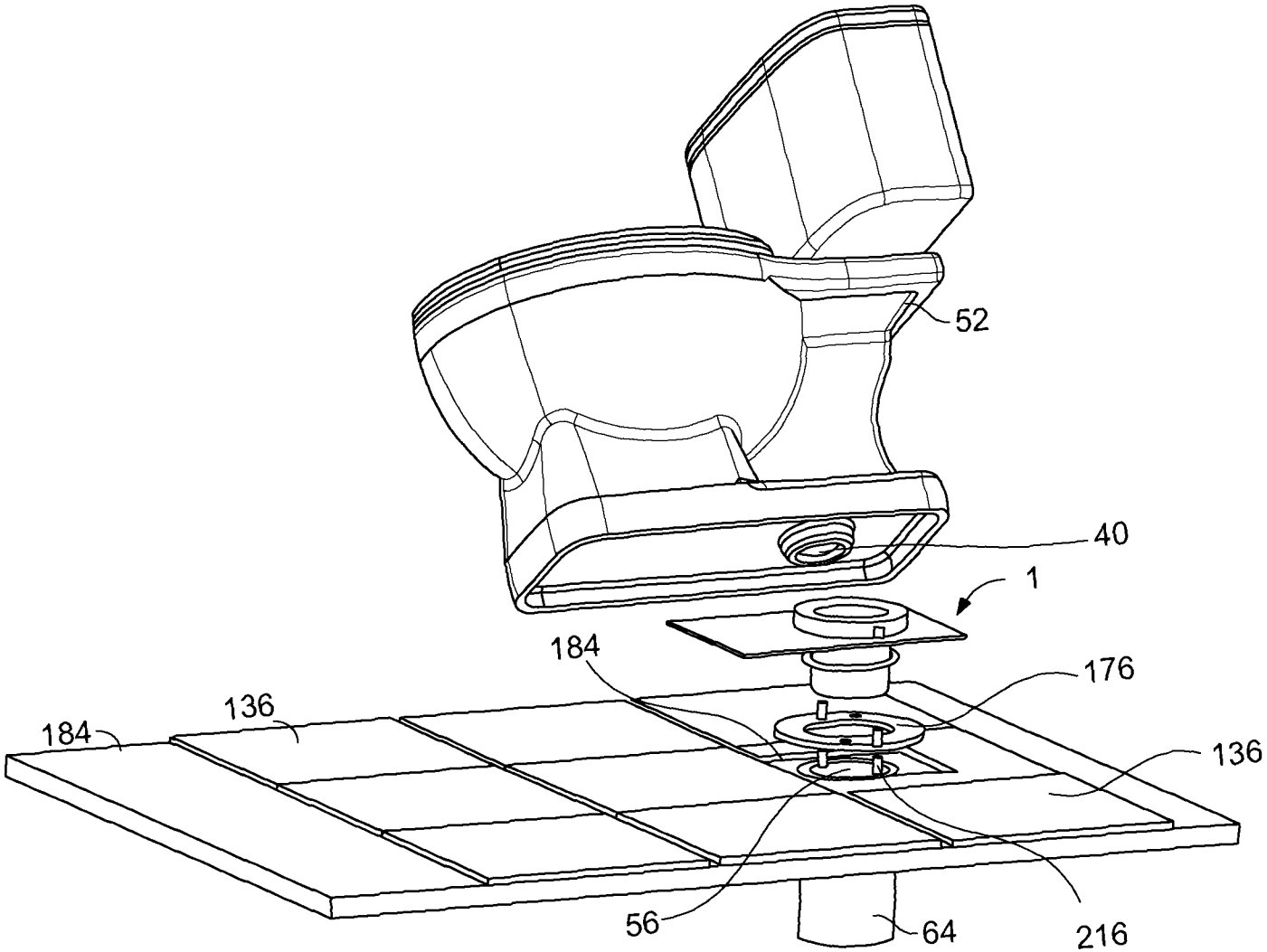
FIG. 5 illustrates an exploded view of an exemplary toilet installation using the exemplary toilet gasket of FIG. 1.

Referring now to FIG. 5, therein illustrated is an exploded view of a toilet installation showing the placement order of the toilet 52, the toilet gasket 1, the toilet flange 176 and the fasteners 216.

According to various exemplary embodiments, toilet gasket 1, the toilet flange 176 and the fasteners 216 may be provided together as a kit. Accordingly, the kit includes almost all the components required to complete the installation of a toilet 52. In particular, where the planar portion 8 of the toilet gasket 1 includes a bottom surface 32 that is pre-coated with adhesive material or any kind of sealing material, minimal set of tools are required to install the toilet 52 using the kit.

According to an exemplary method for installing a toilet 52 using the toilet gasket 1, the toilet flange 176 is disposed about the opening 56 of waste pipe 64. First fasteners 216, such as flange bolts, are suitably positioned so that the head of the fasteners 216 engages the flange 176 while the body of the fasteners 216 is oriented upwardly. Second fasteners, such as screws, are then used to secure the flange 176 to the floor structure 184. The toilet gasket 1 is then positioned such that the tubular portion 96 is inserted into the waste pipe 64 and the at least one annular rib 104 sealingly engages the inner surface 144 of the waste pipe 64. The toilet gasket 1 is also positioned such that the body of the fasteners 216 project through secondary openings 80 of the toilet gasket 1. The distance of the insertion of the tubular portion 96 is adjusted so that the bottom surface 32 of the planar portion 8 sealingly engages the top surface 136 of the finished flooring 188 surrounding the waste pipe 64. For example, where the planar portion 8 has a pre-coated layer of adhesive, the removable layer 72 is removed prior to positioning the toilet gasket 1. Subsequently, the toilet 52 is positioned such that the opening 40 of the outlet duct 48 is positioned over the opening 16 of the toilet gasket 1. For example, the opening 40 is received within the annular member 112 of the toilet gasket 1 to form a watertight seal therewith. The toilet 52 is further positioned such that the bodies of the first fasteners 216 project through openings in the base 92 of the toilet. Cooperating bolts or end caps may be secured to the bodies of the first fasteners 216 to secure the toilet 52 to the toilet flange 176.

Figure 6:
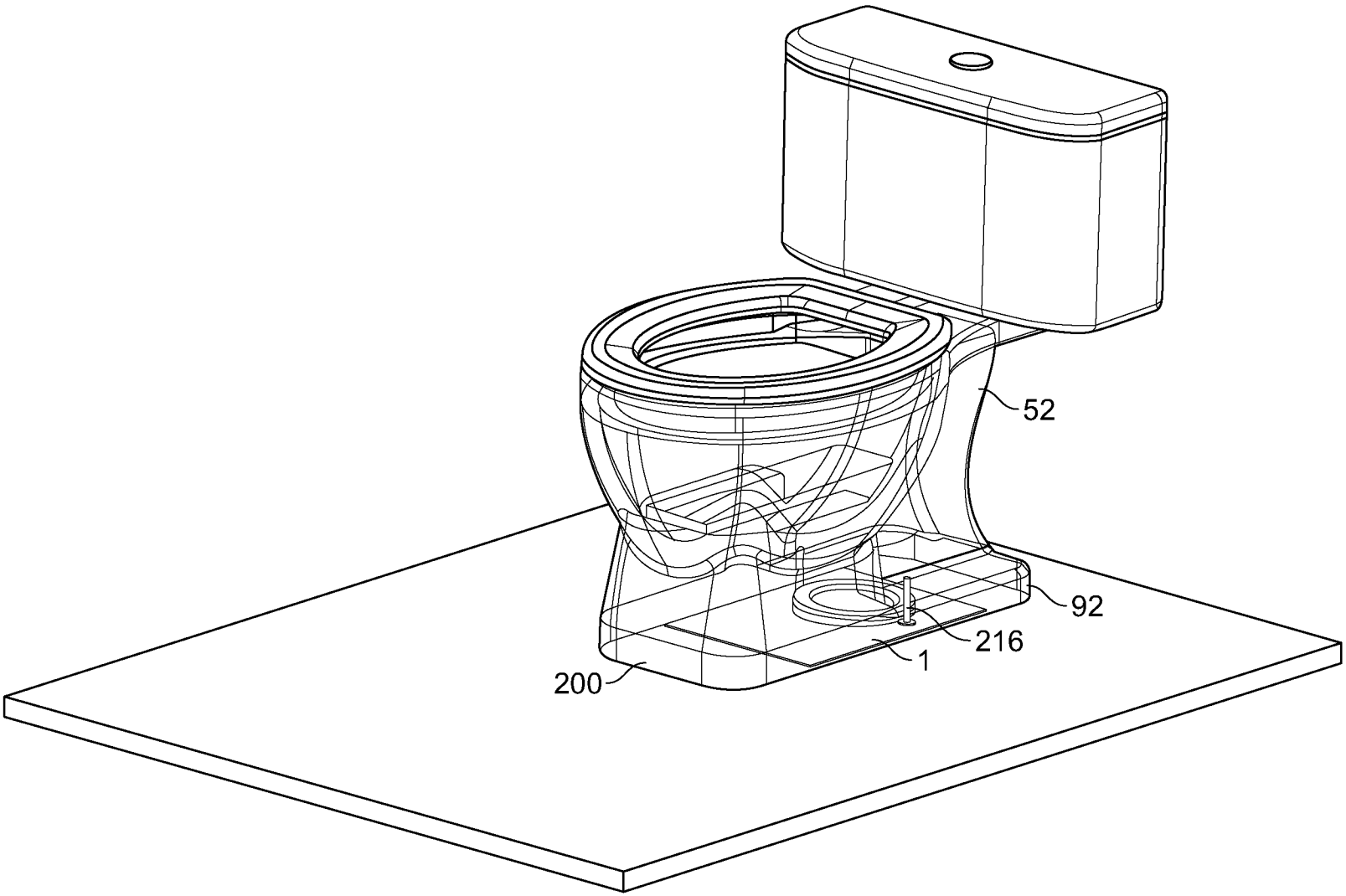
FIG. 6 illustrates a perspective view with transparencies of an exemplary toilet installation using the exemplary toilet gasket of FIG. 1.

Referring now to FIG. 6, therein illustrated is a perspective view with transparencies of an exemplary completed toilet installation using an exemplary toilet gasket 1. The outer contour of the toilet 52 is shown in wireframe. It will be understood that the toilet gasket 1 is positioned entirely within the toilet base 92 and would not be visible when the toilet 52 is shown in solid.

According to various exemplary embodiments described herein, the toilet gasket 1 advantageously provides the function of a typical wax ring seal in that the toilet gasket 1 provides sealing of the outlet duct 48 of the toilet 52 with the waste pipe 64. The annular member 112 restricts flow of water between the outlet 48 and a top surface of the planar portion 8.

As is known in the art, the height of the top surface 136 of the finished flooring 188 above the surface of the floor structure 184 may vary depending on the type of finished flooring 188 that is used. As is further known in the art, a toilet flange extension kit may be used so as to raise or extend the height of the toilet flange 176 above the surface of the floor structure 184. For example, it may be desirable to raise or extend the height of the toilet flange 176 so that it corresponds with the height of the top surface 136 of the finished flooring 188. According to various exemplary embodiments described herein, the toilet gasket 1 advantageously obviates the need to use the toilet flange 176, even for varying heights of the top surface 136 of the finished flooring 188. The providing of a watertight seal by the annular rib 104 of the tubular portion 96 allows the distance at which the tubular portion 96 is inserted into the waste pipe 64 to be varied while still ensuring that the watertight seal is achieved. It will be appreciated that varying the insertion distance of the tubular portion 96 further varies the height of the planar portion 8 of the toilet gasket 1 above the surface of the floor structure 184. During installation using the toilet gasket 1, the tubular portion 96 can be sufficiently inserted into the waste pipe 64 such that the planar portion 8 is substantially aligned with the top surface 136 of the finished flooring 188. The planar portion 8 can then sealingly engage the top surface 136 and the annular rib 104 can sealingly engage the inner wall 144 of the waste pipe 64.

According to various exemplary embodiments described herein, the toilet gasket 1 restricts spills or leakage of water into or out of the waste pipe 64 during backflow of water in the waste pipe 64 in at least a first way. Backflow of water as described herein refers to any flow of water from the waste pipe 64 towards the outlet duct 48 of the toilet 52. Backflow of water may be caused by a blockage within the waste pipe 64 or within a main sewage system, whereby addition of water causes water to rise in the waste pipe 64. Advantageously, the sealing engagement of the annular rib 104 with the inner surface 144 of the waste pipe 64 restricts of flow of water between the outer surface of the tubular member 96 and the inner surface of the waste pipe 64. Accordingly, during backflow of water, the water is channeled through the channel defined by the tubular member 96 and into the outlet duct 48 of the toilet 52. This channeling of water towards the outlet duct 48 may be further aided by the sealing engagement of the opening 40 of the outlet duct 48 with the opening 56 of the waste pipe 64 provided by the annular member 112. Backflow of water towards the outlet duct 48 may enter the toilet bowl 168. Advantageously, the toilet bowl 168 presents a reservoir for the backflow of water and acts as a buffer in that the toilet bowl 168 can contain a substantial amount of water that is backflowed before spilling over from the toilet bowl 168.

According to various exemplary embodiments described herein, the toilet gasket 1 restricts spills or leakage of water into or out of the waste pipe 64 during backflow of water in the waste pipe 64 in at least a second way. For example, where there is standing water on the surface 136 in an area surrounding the waste pipe 64 or the toilet 52, the water may flow through an opening in the floor structure 184 that was made to accommodate the waste pipe 64. It will be appreciated that the opening in the floor structure 184 is often slightly larger than the waste pipe 64, thereby presenting gaps where water may leak into the floor structure 184 and outside of the waste pipe 64. It will be further appreciated that the waste pipe 64 may represent a low point in the bathroom floor and water will tend to flow towards the waste pipe 64. Such leaks may cause damage to the floor structure 184 or other parts of the building. Such leaks may also reach lower floors beneath the toilet 52 and cause unsightly stains in the ceiling of a lower floor. Standing water on the surface 136 of the finished flooring 188 may be caused by various sources, such as a spill, leakage or overuse of water in another water source in the bathroom (ex: sink, shower, bathtub, washing machine) or spill or leakage from the toilet 52 itself (ex: if backflow is so substantial that it overflows the toilet bowl 168). Advantageously, the sealing engagement of the planar portion 8 with the surface 136 of the finished flooring 188 restricts standing water from reaching the waste pipe 64. In particular, the sealing engagement restricts water surrounding the toilet 52 and the waste pipe 64 to flow between the bottom surface 32 of the planar portion 8 and the top surface 136 of the finished flooring 188 towards an area in proximity of the waste pipe 64, such as the opening in the floor structure 184. Accordingly, the standing water is maintained over the surface 136. It will be appreciated that the finished flooring 188 is often chosen to accommodate some standing water. Maintaining the standing water over the finished flooring 188 allow the standing water to be cleaned away.

Figure 7:
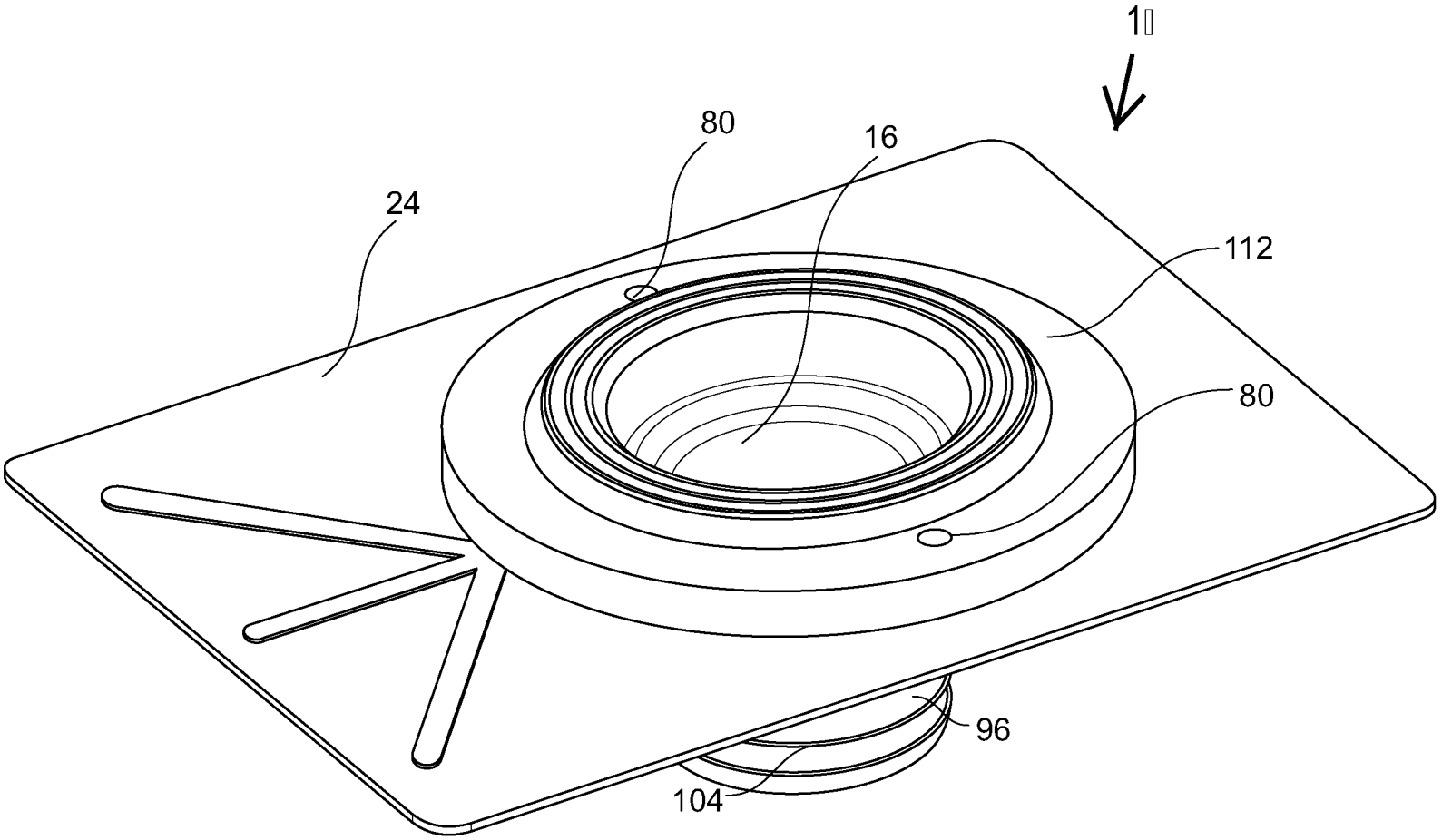
FIG. 7 illustrates a perspective view of a toilet gasket according to another exemplary embodiment.

Referring now to FIG. 7, therein illustrated is a perspective view of a gasket 1' toilet according to various exemplary embodiments.

Figure 8:
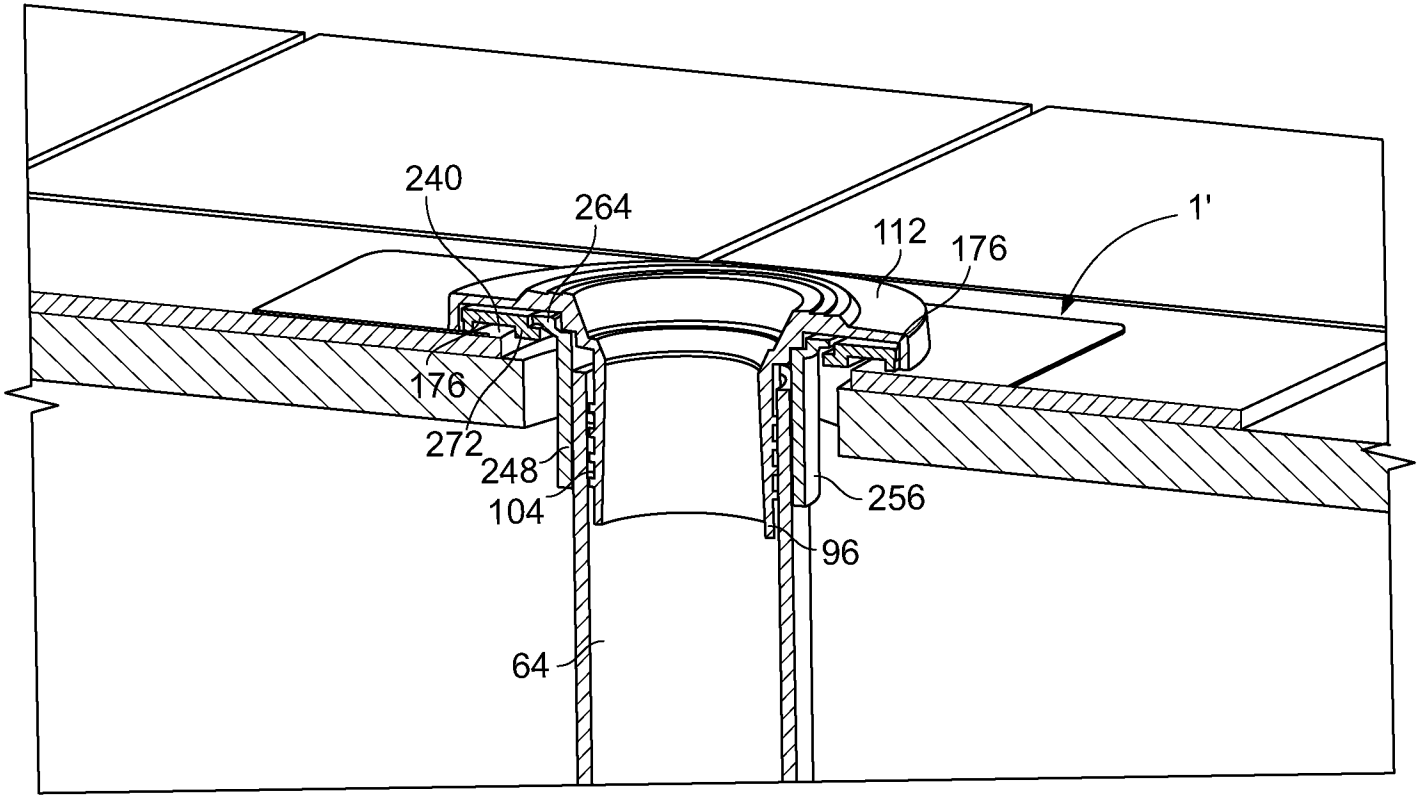
FIG. 8 illustrates a perspective section view of an exemplary toilet installation using the exemplary toilet gasket of FIG. 7.

Referring now to FIG. 8, therein illustrated is a perspective section view of an exemplary toilet installation using a variant toilet gasket 1. The annular member 112 defines an annular chamber 240. For example, the flange 176 may be received within the annular chamber 240.

Continuing with FIG. 8, a fitting member 248 according to a first example is used within the installation. The fitting member 248 includes a tubular portion 256. According to one exemplary embodiment, the tubular portion 256 is sized according to an outer diameter of the waste pipe 64. For example, the waste pipe 64 may have an outer diameter of 3 inches and the tubular portion 256 of the fitting member 248 has an inner diameter of 3 inches. The tubular portion 256 provides a snug fit about the waste pipe 64 so as to form a seal with the waste pipe.

The tubular portion 256 may further include a lip portion 264 that extends circumferentially about an end of the tubular portion 256. The lip portion 264 may have an L-shaped cross-section. The lip portion 264 may cooperatively engage a corresponding lip portion 272 of the flange portion 176. The lip portion 264 of the flange may also have an L-shaped cross-section. Engagement of the flange 176 with the fitting member 248 helps retain the fitting member 248 in place within the installation.

Figure 9:
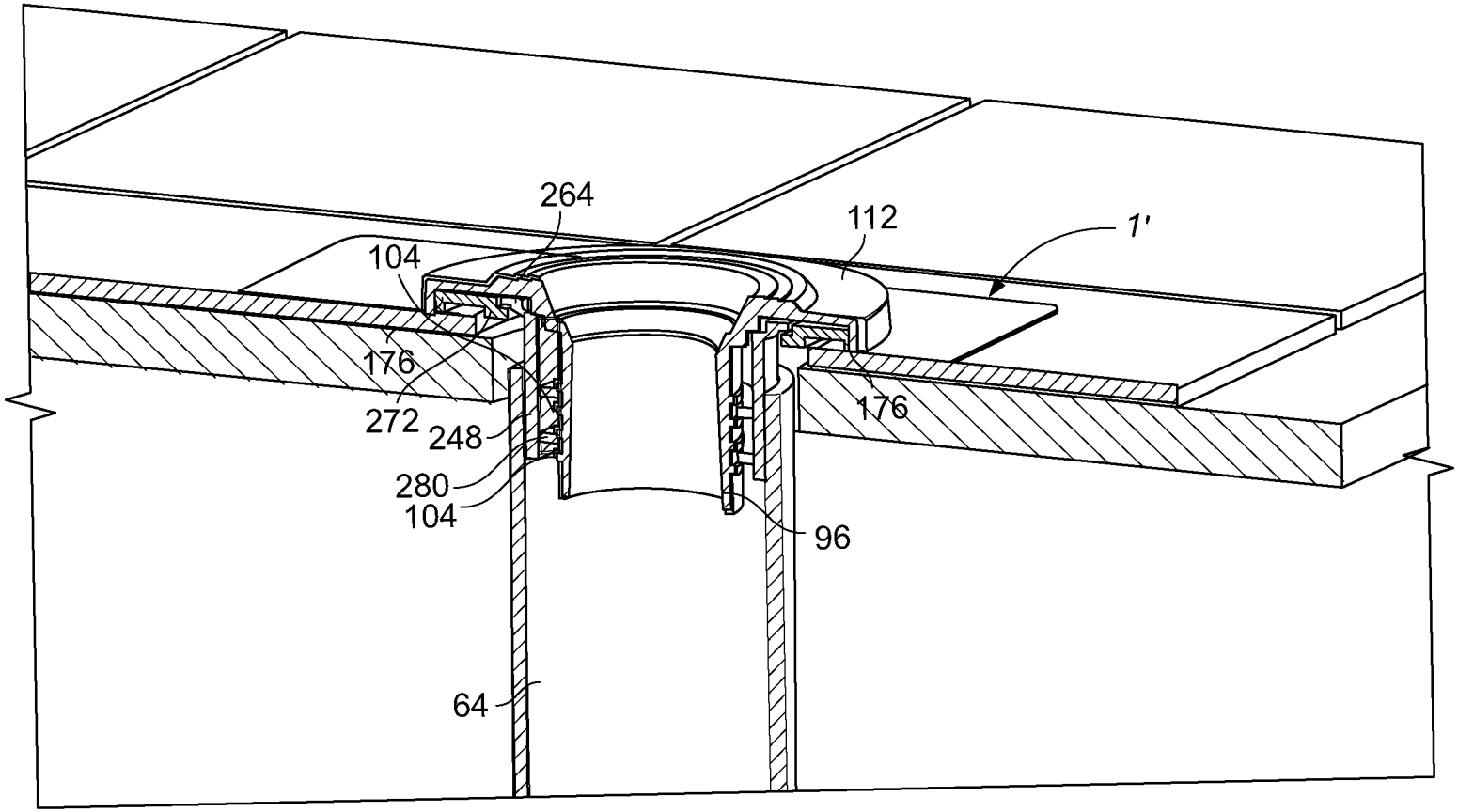
FIG. 9 illustrates a perspective section view of another exemplary toilet installation using the exemplary toilet gasket of FIG. 7.

Referring now to FIG. 9, therein illustrated is a perspective section view of an exemplary toilet installation using a fitting member 248 according to a second example. The tubular portion 256 of the fitting member is sized according to an inner diameter of the waste pipe 64. For example, the waste pipe 64 has an inner diameter of 3 inches and the tubular portion 256 of the fitting member 248 has an inner diameter of 3 inches. The tubular portion 256 still provides a snug fit about the waste pipe 64 so as to form a seal with the waste pipe 64. The lip portion 264 may cooperatively engage a corresponding lip portion 272 of the flange portion 176. The lip portion 264 of the flange may also have an L-shaped cross-section. Engagement of the flange 176 with the fitting member 248 helps retain the fitting member 248 in place within the installation.

The exemplary toilet installation illustrated in FIG. 9 further includes at least one disc member 280. For example, and as illustrated, the exemplary toilet installation includes two disc members 280. The disc members are dimensioned according to an outer diameter of the tubular portion 96 of the gasket 1. For example, the disc members cooperatively engage annular rib 104 of the gasket 1. The disc members are further dimensioned according to an inner diameter of the waste pipe 64 to sealingly engage the inner surface of the waste pipe 64 to seal the waste pipe. It will be appreciated that in various exemplary embodiments, the diameter of the annular ribs 104 may be smaller than the inner diameter of the waste pipe 64 and the waste pipe 64 is sealed through the disc members 280.

Figure 10:
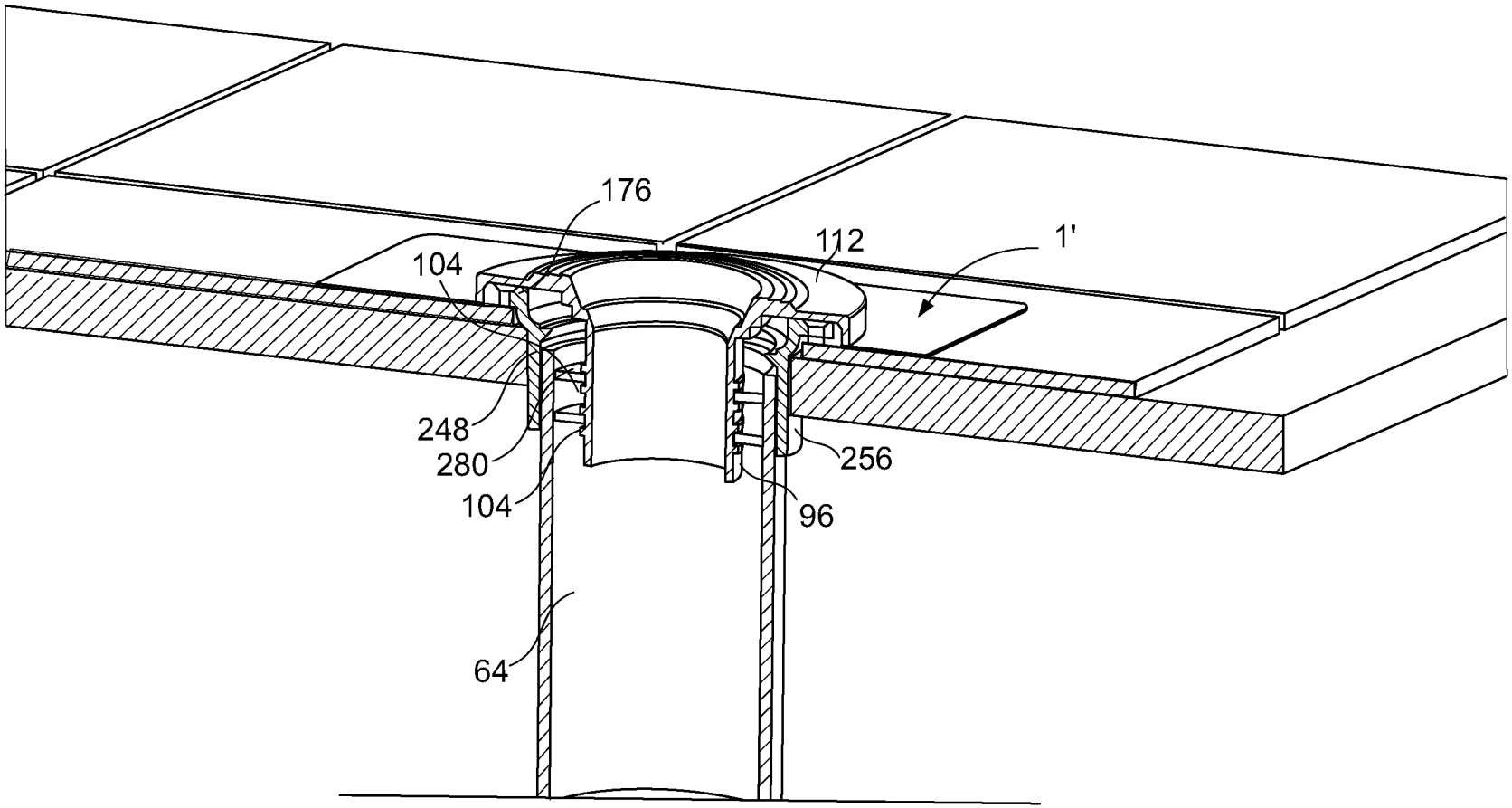
FIG. 10 illustrates a perspective section view of a further exemplary toilet installation using the exemplary toilet gasket of FIG. 7.

Referring now to FIG. 10, therein illustrated is a perspective section view of an exemplary toilet installation using a fitting member 248 according to a third example. According to this example, the flange 176 and the fitting member 248 are integrally formed. Accordingly, the fitting member 248 corresponds to a tubular portion 256 of the flange 176. According to this example, the tubular portion 256 seals an outer surface of the waste pipe 64. Disc members are also provided to seal the inner channel of the waste pipe 64.

Figure 11:
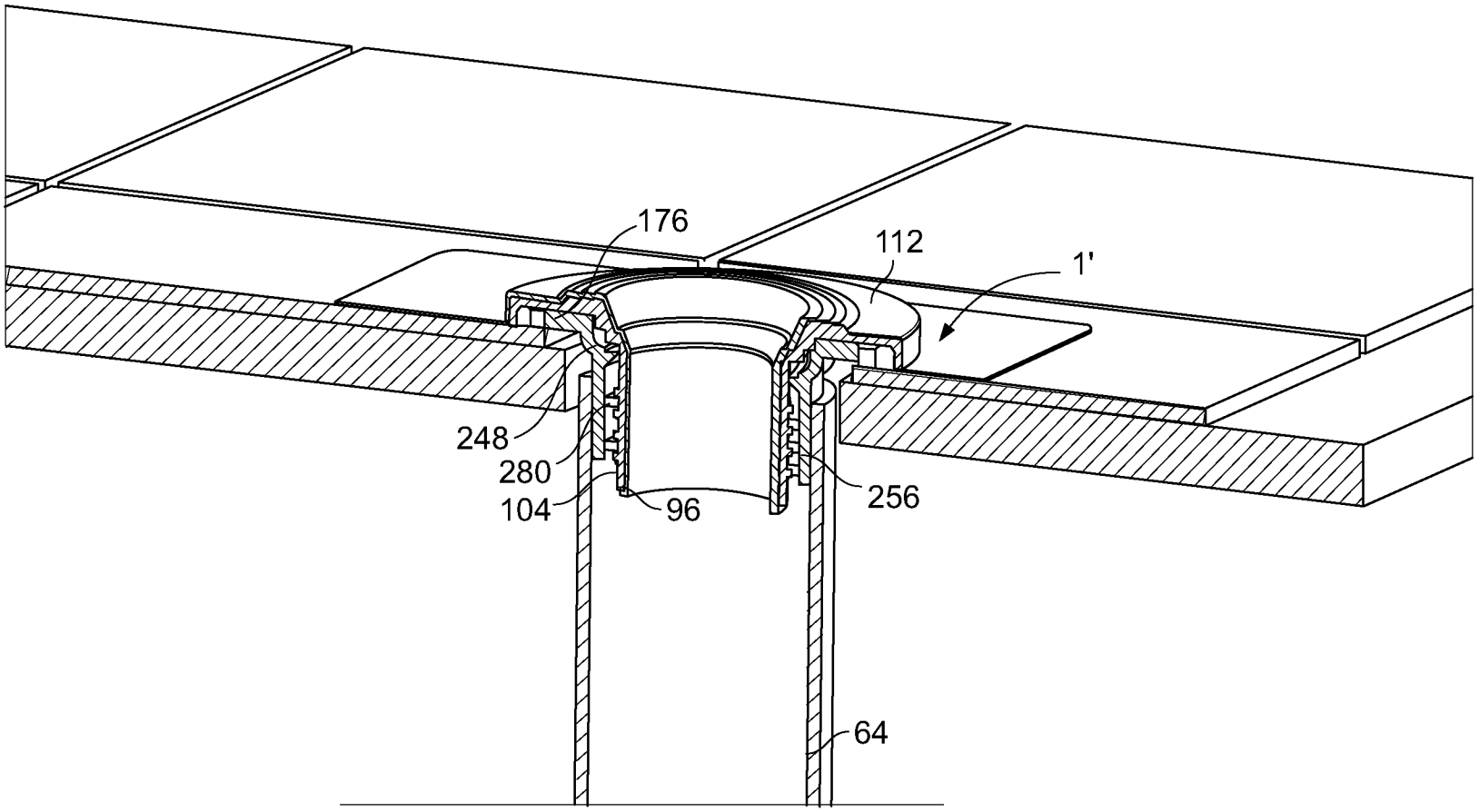
FIG. 11 illustrates a perspective section view of still another exemplary toilet installation using the exemplary toilet gasket of FIG. 7.

Referring now to FIG. 11, therein illustrated is a perspective section view of an exemplary toilet installation using a fitting member 248 according to a fourth example. According to this example, the flange 176 and the fitting member 248 are also integrally formed and the fitting member 248 corresponds to a tubular portion 256 of the flange 176. According to this example, the tubular portion 256 seals an inner surface of the waste pipe 64. Disc members are also provided to seal the inner channel of the waste pipe 64. For example, the disc members may engage an inner surface of the tubular portion 256 to provide sealing of the waste pipe 64.

Figure 12:
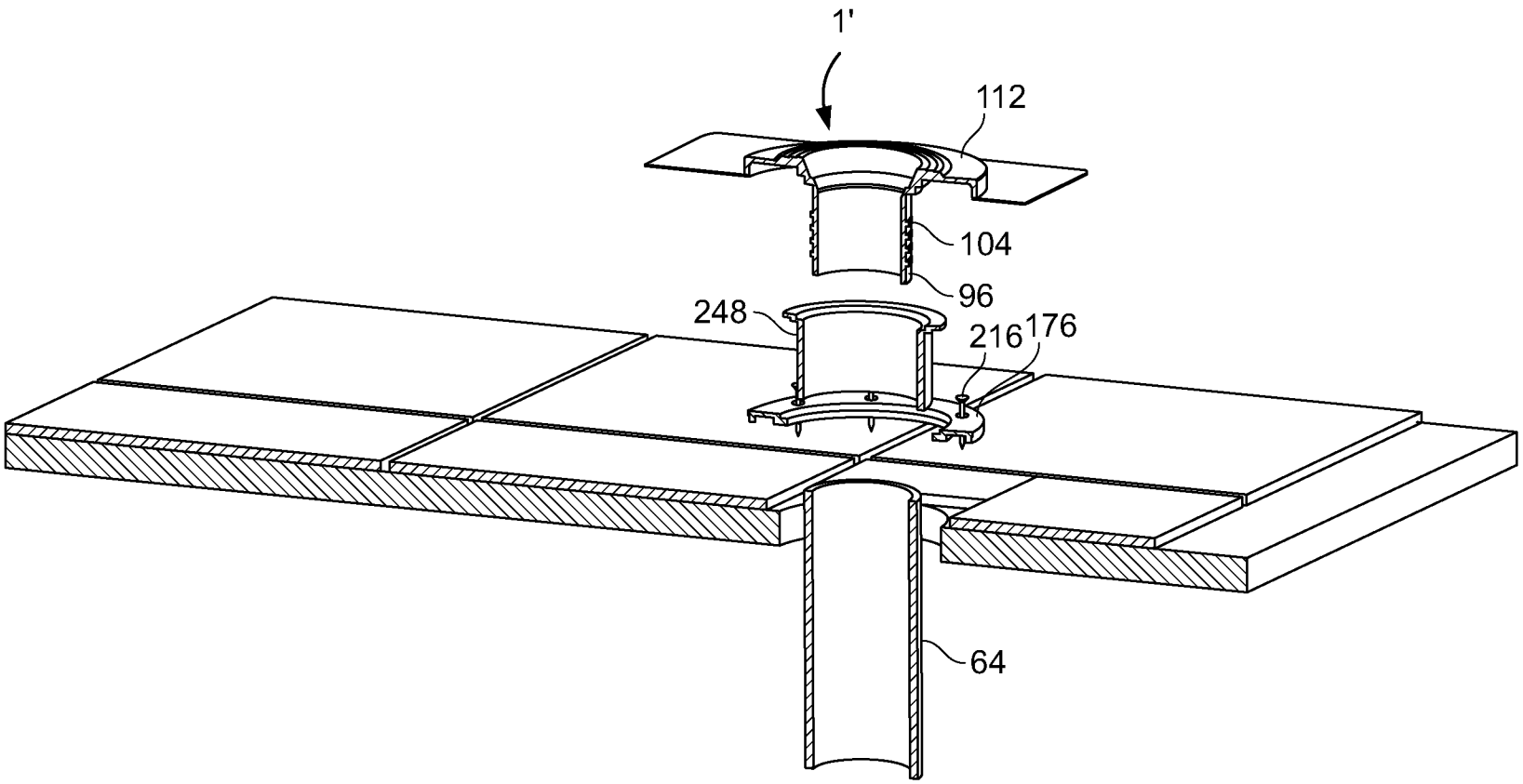
FIG. 12 illustrates an exploded section view of yet another exemplary toilet installation using the exemplary toilet gasket of FIG. 7.

Referring now to FIG. 12, therein illustrated is an exploded section view of an exemplary toilet installation.

Figure 13:
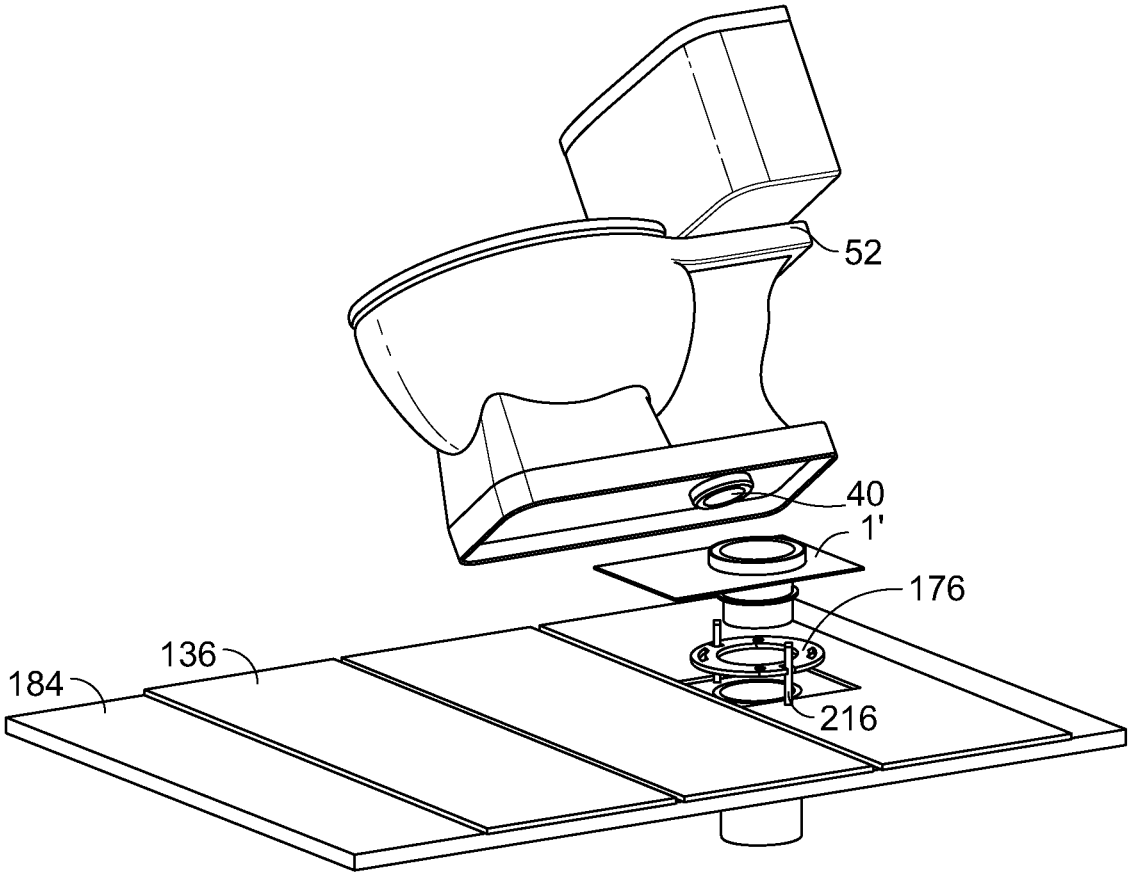
FIG. 13 illustrates an exploded view of yet a further exemplary toilet installation using the exemplary toilet gasket of FIG. 7.

Referring now to FIG. 13, therein illustrated is an exploded view of an exemplary toilet installation.

The disc members can be of various dimensions such as a diameter of 3, 3.5 or 4 inches.

According to various exemplary embodiments, a kit for performing a toilet installation includes a gasket according to various exemplary embodiments described herein, a flange according to various exemplary embodiments described herein, and at least two fasteners for securing the flange to the toilet.

According to various exemplary embodiments, the kit further includes instructions for installing the kit and connecting it to the toilet.

According to various exemplary embodiments, the kit further includes a fitting member according to various exemplary embodiments described herein.

According to various exemplary embodiments, the kit further at least two fitting members having different inner or outer diameters.

According to various exemplary embodiments, the kit further at least two annular disc members having different inner or outer diameters.

According to various exemplary embodiments, the kit further includes a plurality of disc members 280 according to various exemplary embodiments. For example, at least two of the disc members 280 have different outer diameters. For example, the disc members may have outer diameters of about 3 inches to about 5 inches, about 3 inches to about 3 inches, about 3¼ inches to about 3½ inches or about 4¼ inches to about 4½ inches. The outer diameters can be about 3 inches, about 3.5 inches and/or 4.0 inches.

For example, the kit can comprise optionally at least one fitting member, at least one gasket as defined in the present disclosure, at least one flange, at least two fasteners.

For example, the kit can comprise at least one fitting member, at least one gasket as defined in the present disclosure, at least one flange, at least two fasteners, at least one annular disc member.

For example, the kit can comprise at least one fitting member, at least one gasket as defined in the present disclosure, at least one flange, at least two fasteners, at least one annular disc member of 3 inches, at least one annular disc member of 3.5 inches, and at least one annular disc member of 4 inches.

It will be appreciated that the providing of fitting members 248 of different diameters and/or disc members 280 of the different diameters within a single kit allows the kit to be easily adapted to waste pipes 64 of different diameters. That is, the single kit may be suitable for waste pipes of different diameters. Accordingly, the size of the waste pipe does not need to be known prior to selecting materials for the installations. This allows saving of time and materials, such as not having to procure further materials because the initial materials are not properly dimensioned for a particular waste pipe 64.

For example, the gasket 1 can be made of a polymer.

For example, the gasket 1 can comprise rubber.

For example, the flange 176 can be made of a polymer.

For example, the flange 176 can comprise ABS (acrylonitrile butadiene styrene).

For example, the fasteners 216 can be made of a polymer.

For example, the fasteners 216 can comprise nylon.

For example, the gasket 1, the flange 176 and the fasteners 216 can be made of at least one material that is resistant to corrosion.

For example, the gasket 1, the flange 176 and the fasteners 216 can be made of materials that are resistant to corrosion.

For example, the gasket 1, the flange 176 and the fasteners 216 can be made of at least one recycled material.

For example, the gasket 1, the flange 176 and the fasteners 216 can be made of recycled materials.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

The invention claimed is:

1. A toilet gasket comprising:

a planar portion defining a primary opening for alignment with an outlet duct of a toilet and an inlet of a waste pipe, a bottom surface of the planar portion being dimensioned to sealingly engage a floor surface surrounding the waste pipe, the planar portion defining a surface area that is equal or inferior to a surface area defined by a base of the toilet;

a tubular portion extending from the bottom surface of the planar portion and about the opening, the tubular portion defining a channel in fluid flow communication with the opening, an outer surface of the tubular portion having at least one rib member dimensioned to sealingly engage the inner surface of the waste pipe when the tubular portion is inserted within the waste pipe; and an annular member extending from a top surface of the planar portion and about the opening and being adapted to sealingly engage at least one of an end wall and an outer side wall of the outlet of the toilet, the annular member defining an annular chamber extending circumferentially around the opening and being configured to receive a toilet flange therein;

wherein the toilet gasket is made of a single piece, and wherein the planar portion defines an outer edge of the toilet gasket.

2. The toilet gasket of claim 1, wherein the planar portion is of uniform thickness.

3. The toilet gasket of claim 1, wherein sealing engagement of the outlet of the toilet with the annular member restricts flow of water between the outlet and the top surface of the planar portion.

4. The toilet gasket of claim 1, wherein the planar portion is sized to extend substantially beyond an outer wall of the outlet of the toilet and within the exterior walls of a base of the toilet.

5. The toilet gasket of claim 1, wherein the bottom surface of the planar portion is coated with adhesive, the adhesive further being covered by a removable layer.

6. The toilet gasket of claim 5, wherein removal of the removable layer exposes the adhesive, the adhesive being adapted to adhere the bottom surface of the planar portion to the surface surrounding the waste pipe to form a seal therewith.

7. The toilet gasket of claim 1, wherein sealing engagement of the rib with the inner surface of the waste pipe restricts flow of water between the outer surface of the tubular member and the inner surface of the waste pipe during backflow of water in the waste pipe, thereby channeling the backflow towards the outlet duct of the toilet and into a bowl of the toilet.

8. The toilet gasket of claim 1, wherein sealing engagement of the planar portion with the floor surface restricts flow of water standing on the floor surface surrounding the waste pipe between the planar portion and the floor surface towards an area in proximity of the waste pipe.

9. The toilet gasket of claim 1, wherein sealing engagement of the planar portion with the floor surface substantially prevents water disposed outside the base of the toilet from flowing through a floor opening defined within the floor and around the waste pipe.

10. The toilet gasket of claim 1, wherein the planar portion and the tubular portion are formed of at least one of rubber, soft plastic and polymer.

11. The toilet gasket of claim 1, wherein the planar portion further defines a plurality of secondary openings for receiving fasteners.

12. The toilet gasket of claim 1, wherein the planar portion is substantially flexible and is adapted to conform to discontinuities in the surface surrounding the waste pipe.

13. The toilet gasket of claim 1, wherein the planar portion of the toilet gasket is substantially flat and continuous and the planar portion extends continuously from the primary opening up to an external periphery of the gasket.

14. A toilet sealing assembly kit comprising:

the gasket of claim 1;

a flange defining a plurality of openings and being adapted to be secured to an underlying surface;

at least two fasteners adapted to project through secondary openings of the planar portion and the openings of the flange to secure the toilet and the flange.

15. The kit of claim 14, wherein the flange comprises a lip portion for engaging the gasket and a flange tubular portion extending from the lip portion for sealingly engaging one of an inner surface of the waste pipe and an outer surface of the waste pipe.

16. The kit of claim 14, further comprising a fitting member comprising a fitting tubular portion for sealingly engaging one of an inner surface of the waste pipe and an outer surface of the waste pipe.

17. A toilet gasket comprising:

a planar portion defining a primary opening for alignment with an outlet duct of a toilet and an inlet of a waste pipe, a bottom surface of the planar portion being dimensioned to sealingly engage a floor surface surrounding the waste pipe, the planar portion defining a surface area that is equal or inferior to a surface area defined by a base of the toilet;

a tubular portion extending from the bottom surface of the planar portion and about the opening, the tubular portion defining a channel in fluid flow communication with the opening, an outer surface of the tubular portion having at least one rib member dimensioned to sealingly engage the inner surface of the waste pipe when the tubular portion is inserted within the waste pipe; and an annular member extending from a top surface of the planar portion and about the opening and being adapted to sealingly engage at least one of an end wall and an outer side wall of the outlet of the toilet, the annular member defining an annular chamber extending circumferentially around the opening and being configured to receive a toilet flange therein;

wherein the toilet gasket is made of a single piece, and wherein the entire periphery of the annular member is surrounded by the planar portion.

18. A toilet gasket comprising:

a planar portion defining a primary opening for alignment with an outlet duct of a toilet and an inlet of a waste pipe, a bottom surface of the planar portion being dimensioned to sealingly engage a floor surface surrounding the waste pipe, the planar portion defining a surface area that is equal or inferior to a surface area defined by a base of the toilet;

a tubular portion extending from the bottom surface of the planar portion and about the opening, the tubular portion defining a channel in fluid flow communication with the opening, an outer surface of the tubular portion having at least one rib member dimensioned to sealingly engage the inner surface of the waste pipe when the tubular portion is inserted within the waste pipe; and an annular member extending from a top surface of the planar portion and about the opening and being adapted to sealingly engage at least one of an end wall and an outer side wall of the outlet of the toilet, the annular member defining an annular chamber extending circumferentially around the opening and being configured to receive a toilet flange therein;

wherein the toilet gasket is made of a single piece, and wherein the bottom surface of the planar portion is coated with adhesive, the adhesive further being covered by a removable layer.

19. A toilet gasket comprising:

a planar portion defining a primary opening for alignment with an outlet duct of a toilet and an inlet of a waste pipe, a bottom surface of the planar portion being dimensioned to sealingly engage a floor surface surrounding the waste pipe, the planar portion defining a surface area that is equal or inferior to a surface area defined by a base of the toilet; and an annular member extending from a top surface of the planar portion and about the opening and being adapted to sealingly engage at least one of an end wall and an outer side wall of the outlet of the toilet, the annular member defining an annular chamber extending circumferentially around the opening and being configured to receive a toilet flange therein;

wherein the toilet gasket is optionally made of a single piece, and wherein the planar portion defines an outer edge of the toilet gasket.

* * * * *